US005458204A

United States Patent [19]

Tünkers

[11] Patent Number: 5,458,204

[45] Date of Patent: Oct. 17, 1995

[54] VIBRATION PILE DRIVER FOR RAMMING AND/OR PULLING OF RAM MATERIAL

[75] Inventor: Josef-Gerhard Tünkers, Ratingen, Germany

[73] Assignee: Tunkers Maschinenbau GmbH, Ratingen, Germany

[21] Appl. No.: 273,325

[22] Filed: Jul. 11, 1994

[30] Foreign Application Priority Data

Aug. 27, 1993 [DE] Germany ..... 9312846 U

[51] Int. Cl.[6] ..... F02D 7/18

[52] U.S. Cl. ..... 173/49

[58] Field of Search ..... 173/49; 175/56; 405/232

[56] References Cited

U.S. PATENT DOCUMENTS

| | | | |
|---|---|---|---|
| 3,433,311 | 3/1969 | LeBelle | 173/49 |
| 3,564,932 | 2/1971 | LeBelle | 173/49 |
| 4,061,196 | 12/1977 | Herz | 173/49 |
| 4,471,666 | 9/1984 | Unrath et al. | 173/49 |
| 5,263,544 | 11/1993 | White | 173/49 |

*Primary Examiner*—Scott A. Smith
*Attorney, Agent, or Firm*—Antonelli, Terry, Stout & Kraus

[57] ABSTRACT

A vibration pile driver for ramming and/or pulling ram material in which eccentric masses are positively coupled in pairs by flexible draw elements and are adapted to be continuously adjusted and locked in opposite directions.

8 Claims, 5 Drawing Sheets

VIBRATION PILE DRIVER FOR RAMMING AND/OR PULLING OF RAM MATERIAL

FIELD OF THE INVENTION

The present invention relates to a vibration pile driver for ramming and/or pulling ram material with at least four motor-driven eccentric agitators to each of which at least one eccentric mass with variable static moment is arranged, whereby the effective eccentric radius of the eccentric masses on the corresponding eccentric shaft can be adjusted and the adjustment of the eccentric masses can be effected synchronously and in the same direction.

BACKGROUND OF THE INVENTION

DE-OS 29 32 287 proposes a vibration pile driver for ramming and/or pulling of rammed bodies such as posts and piles, etc., with the drivers having at least two synchronous eccentric rotors each of which can be driven by at least one motor and one gear box, and each of which has at least two eccentric masses which can be driven around the same axis and adjusted angularly relative to each other, whereby the eccentric masses of each eccentric rotor are mounted on separate shafts arranged concentrically to each other, and whereby, for at least one of these shafts, an adjustment device is provided for displacing the phase position of one shaft relative to the other shaft. The phase adjustment device is integrated in part into the gear box. One of the shafts of the eccentric rotors takes the form of a hollow shaft supported on the other. The phase adjustment device is a part of a planetary gear system whose planet wheel, engaging an annular gear forming the sun wheel of the shaft to be rotated, forms the drive wheel of this shaft, whereby this shaft is adjustable relative to the other shaft along a circle concentric to the latter, in order to adjust the phase position. The planet wheel can be driven via a bypass gear, by a transmission gear which, at the same time serves to drive the other shaft of the eccentric rotors. The vibration pile drive is constructed in such a way that the gears engaging the planet wheel are supported at least partially by a bearing arranged between and connected to two swivel mounted levers. One swivel mounted lever can be swung around the axis of the two shafts of the one eccentric rotor which is adjustable relative to each other. The other swivel mounted lever can be swung around the axis parallel to the axis of the transmission drive shaft. The swivel action of one of the swivel mounted levers is continuously adjusted between two end positions. The planet wheel and the intermediate gear wheel of the bypass gear are each connected in bearings to one of the two swivel mounted levers. In the bearing assembly, these two gears are engaged by two intermediate gears arranged between them. The bearing positions of all of the gears define the corners of a trapezium. A cylinder and piston acts as an adjustment device, the piston rod of which is connected to a swivel mounted lever. The maximum arc described by the swivel mounted lever corresponds to a rotation of the rotor shaft through 180° relative to each other. The vibration pile driver is equipped with an indicator device showing the effective static moment thereby permitting the static moment of the vibration pile driver to be remotely controlled and continuously adjusted from zero to a maximum value during a ramming or pulling action.

The prior art device is extraordinarily complicated in construction. This may be the reason why it has, to date, not been possible for this design to be used in practice.

With the vibration pile drivers used in practice, there is a risk of resonance if the operating speed drops, so that uncontrollable vibrations can be transmitted to nearby buildings and in the ground across a wide area of, for example, 50 to 200 meters. In order to make resonance-free vibration work possible, a high reserve of performance must always be provided so that a strong centrifugal force and a constant operating speed is always available even with the heavy ram material and in heavy soil conditions. This is very important when working in residential areas, near railway installations and other buildings sensitive to vibration.

A further cause of resonance vibrations from hydraulic vibration pile drivers is the long start-up and breaking times of the eccentric masses. This enormous disadvantage has its origins in the physics and of the design of the equipment and can only be eliminated conditionally at the expense of rapid wear of the hydraulic drive motors. When the vibration driver is started up, the aperiodic vibration must be generated immediately at full power. This means high operating pressure and long run-up to the nominal speed of the eccentric masses. As a rule, a resonance range is run through linearly relatively slowly, with the result that, during this period, resonance vibrations can build up and affect the ground for a relatively long time. The same effect occurs during deceleration of the eccentric masses, when the resonance range runs through the time determined by the design. The result of reducing the start-up and braking time is that the inertia of the rotating masses (eccentrics, shafts, couplings) could cavitate the hydraulic motors which would fail after a short time.

DE-PS 35 15 690 proposes a vibration pile drive with eccentric adjustment for ramming and/or pulling ram material, with at least two eccentric motors supported in parallel bearings, and driven by at least one motor and gear box synchronously and oppositely. Each of these eccentric motors comprises two eccentric masses mounted on concentrically arranged shafts synchronously driven and adjustable angularly relative to each other by an adjustment device. Each of the first eccentric masses of both eccentric motors can be driven in opposite directions via a first gear train and each of the second eccentric masses can be driven in opposite directions by a second gear train. The eccentric motor is constructed in the form of a rotary piston adjustment device, in which both eccentric masses are arranged in a cylindrical closed housing and the first eccentric mass forms a radial web permanently attached to the housing, while the second eccentric mass forms the radial blade which can be rotated within limits in the housing and is sealed off from the housing and the web. Hydraulic fluid is applied to each of the two chambers formed between the blade and the web, alternately through their own control conduit. Essentially each eccentric mass is, in cross section sectored, with each eccentric mass extending through a quarter circle. The eccentric mass forming the blades is connected with an internal shaft, in which axial holes are provided for the hydraulic fluid, whereby the control conduits are connected to the ends of the shaft and are sealed off from the shaft by shaft seals. The design of the second eccentric rotor is similar to that of the first eccentric rotor, except for the fact that, with the second eccentric rotor, the two chambers are connected to each other by a connection hole and two control conduits are eliminated. The hydraulic motors grip the shafts of the second eccentric rotor. The angle of the eccentric masses can be adjusted relative to the eccentric rotors both during operation and when stationary. This is achieved, for example, by introducing hydraulic fluid into chambers via a valve and control conduits, while, at the same time, hydraulic fluid emerges from another chamber via a control line. The closer the two eccentric masses approach each other, the greater the static moment, which reaches its maximum when the approach of the two eccentric masses is complete. Conversely, the two sectored eccentric masses can be adjusted in opposite directions by the corresponding introduction of hydraulic fluid. If they are arranged diametrically opposite to each other, the centrifugal force of the eccentric masses cancel each other out, and a minimum static moment is achieved. Between these two extreme positions, any intermediate position is possible via a valve, both during operation and while the vibration pile driver is stationary. This opens the possibility of running up these vibration pile drivers without an activated eccentric mass through the critical range and of switching in or activating the eccentric mass or the eccentric masses once the critical speed range (resonance range) has been passed and, when reducing the speed, of again switching out or neutralizing the eccentric masses above the critical resonance range. The disadvantage with this prior art construction is that the relatively complicated construction requires forced synchronization of the eccentric actuators through a reducing gear.

DE-OS 41 39 798 proposes a vibration pile drive in which each eccentric shaft has a hollow rotating piston which is provided with an adjustable eccentric mass. The longitudinal axis of each piston is arranged orthogonally to the longitudinal rotational axis of the corresponding eccentric shaft. Each of the pistons takes the form of a cylinder in which the corresponding cylindrical eccentric mass is arranged so as to the axially displaceable. Pressure transmitting conduits are connected to the cylinders through which pressure media can be applied to cylinder compartments working in the same direction, by partial flow currents, whose basic parameters (flow pressure, flow volume and flow speed) are equally dimensioned. These vibration pile drivers are aimed at achieving a relatively simply construction with which nevertheless the static moment required at each point can be achieved in order to avoid damaging resonance vibrations. In addition, the aim is to be able to adapt to existing operating conditions are required.

At the start of a ramming operation, for example, light ramming work, or at the end of a pulling operation, the static moment is reduced, i.e. reduced centrifugal force at a constant speed, whereby it is perfectly possible to set the centrifugal force to zero. This results in considerably less vibration. Adaptation to the progress of the ramming operation is easily possible by adjusting the eccentric forces.

For heavy ramming operations, if power requirements become so large that the speed drops, the speed can be maintained by reducing the static moment so that disturbing vibrations in the ground and the surrounding area can be avoided. This is very important, for example, when working in residential areas, near to railway installations and other vibration sensitive buildings. Under certain circumstances, the fall off of speed on vibrators with no static moment or centrifugal force adjustment facility during operation, ground vibration can become so great that ramming or pulling operations can no longer be carried out without the risk of building cracking or being similarly damaged.

During the raising and lowering of vibration pile drivers, the eccentric masses are practically switched out, i.e. they are no longer effective as eccentric masses. This means that considerably lower resonance force is applied to the boom, which resonance forces could otherwise prematurely destroy the boom. By this means, efficient operations is achieved which includes a saving in energy. Operationally unfavorable combinations of speed and static moments are therefore avoidable.

As the eccentric masses are attached to the agitator shafts, special bearings, machine parts, gears and complicated planet gears no longer need to be used. This results in a significantly more simple design and a compact and relatively light construction. As a consequence, the entire vibration ram applies only relatively little load to the ram material, avoiding the tendency to buckle and the center of gravity can be favorably located.

The agitator shafts are fashioned as hollow bodies whereby, in each of the hollow shafts, there is at least one piston axially displaceable within the hollow shaft. The corresponding cylindrical compartments in the hollow shafts are each connected to the same pressure media conduit so that the pistons can be adjusted synchronously and in the same direction by pressure medium pressure whose basic parameters (flow pressure, flow volume and flow speed) are equal. For example, pistons representing the eccentric masses can be loaded in their neutral position (zero position) by pressure from a pressure medium, in particular, hydraulic pressure. By correspondingly removing the pressure medium pressure, the pistons can be adjusted continuously to the particular position required by the centrifugal force of the rotating hollow shafts, whereby the eccentric masses are continuously adjustable from their neutral position to their maximum position. By this means, any rotational speed or any particular position can be related to the eccentric masses thus making corresponding adjustments of the static moments possible.

In the zero position (neutral position), the pistons can be located on, or almost on, the rotational axis of the agitator, so that no, or only a minimal, eccentric force and thus no centrifugal force, can develop. As soon as the pistons move away from a neutral position, a specific static moment, depending upon the position of the piston, and a specific centrifugal force depending upon the speed develop. When the piston reaches its end position, the maximum static moment and maximum centrifugal force are reached.

The adjustment can actually be effected hydraulically, pneumatically or electro-mechanically. However, in practice, hydraulic adjustment will probably be given preference.

SUMMARY OF THE INVENTION

The invention is aimed at achieving the objective of constructing a vibration pile drive of the aforementioned type in such a manner that, with simple and reliable design methods, each of the eccentric masses of the vibration pile driver can be angularly and continuously adjusted relative to the drive shaft to which it is assigned.

In accordance with the present invention, a vibration pile driver for ramming and/or pulling ram goods includes at least four motor driven eccentric agitators to each of which at least one eccentric mass is arranged, with adjustable static moment. The eccentric masses are arranged on a corresponding eccentric shaft and are adjusted relative to an effective eccentric radius. The adjustment of the eccentric masses can be effected synchronously and in the same direction. The eccentric masses are forcibly coupled in pairs by a flexible pull element, for example, a serrated belt, with the eccentric mass being continuously adjustable in both directions.

By virtue of the above noted features of the present invention, in a so-called four-shaft vibration pile driver, the eccentrics of each of two pairs of hydraulically or electrically driven vibration pile drivers work in opposition and, in accordance with the invention, the eccentric masses of the eccentric agitators can be coupled together by a pull element, for example, by a serrated tooth belt. In this manner, by suitably arranging the belt path, the eccentric masses can be continuously and very finely adjusted in both directions even during operation. There is no longer any danger of resonance as the eccentric masses are not activated until, for example, the maximum speed has been reached or the critical speed has been passed. It is also possible to adapt the centrifugal force to the ground conditions by continuous adjustment of the corresponding rotational angle of the eccentric masses.

By use of, for example, serrated tooth belts, a simple robust construction is achieved, as gears, stepping motors and similar elements are no longer required. In four-shaft vibration pile drives, it is not possible to neutralize the eccentrics.

According to the present invention, the adjustment of each pull element can be effected by at least one adjustment roller.

The adjustment rollers of the present invention may be adjusted orthogonally to a straight line connecting the center point of shafts of the eccentric masses.

The flexible pull element, fashioned as serrated belts, may, in accordance with the present invention, be looped around the toothed eccentric masses and around each of the toothed guide rollers arranged off center between the shafts of the eccentric masses.

According to the present invention, on each side of a line of symmetry drawn through a center point of a hole of a suspension bearing, four eccentric agitators are arranged in pairs, with guide rollers of the eccentric agitators being continuously adjusted from a neutral to an activated position by jointed adjustment rods by an angularly adjustable adjustment device, with the agitators being adapted to be arrested in each required position.

In accordance with still further features of the present invention, each of the shafts of the eccentric masses is assigned a separate drive motor and all of the drive motors are connected to the same power source.

Advantageously, the separate drive motors may be hydraulic drive motors, with the same power source being a hydraulic pressure conduit without flow splitters or volume regulators being interposed.

DETAILED DESCRIPTION

Figure 1:
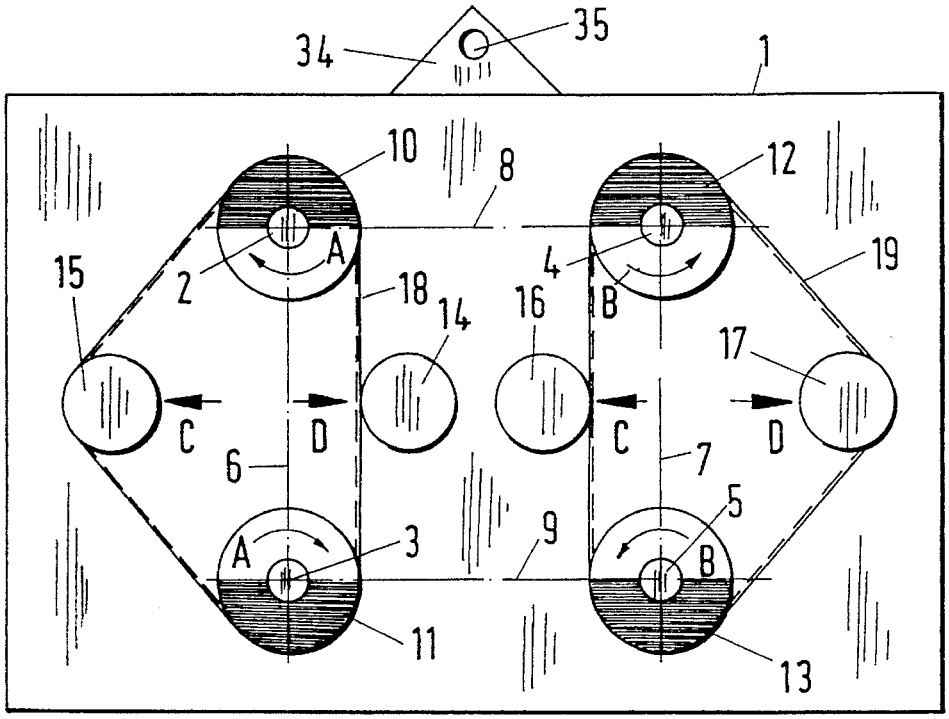
FIG. 1 is a schematic view of a vibration pile driver having four shafts constructed in accordance with the present invention, with eccentric masses in a neutral position.

In the drawing, a rigid vibrator cell 1 includes four shafts 2, 3 and 4, 5 arranged to rotate in bearings (not shown). Each of the shafts 2–5 is allocated to a separate electric or hydro-static drive with the drives being equal in size and power and running at the same speed. For example, in the case of the hydraulic drive, hydro-static motors can be arranged on each of the shafts 2, 3 and 4, 5. As shown in the drawings, the shafts are supported in the rigid vibration cell, spaced apart, and with their longitudinal axes of rotation running parallel to each other. A straight line, drawn through each of the centers of rotation of the shaft pairs, 2, 3 and 4, 5 extends orthogonally through each of the straight connecting lines 8 and 9 connecting the centers of rotation of two adjacent shafts 2, 4 and 3, 5. The connecting lines 8 and 9 also run parallel to each other. If the rigid vibrator cell 1 is set up on a rigid horizontal surface, the connection lines 6 and 7 run vertically, while the connecting lines 8 and 9 are horizontal. The pairs of shafts 2, 3 and 4, 5 rotate in opposite directions. The shafts 2, 3 are driven in the direction indicated by the arrow A and the shafts 4, 5 are driven in the direction indicated by the arrow B.

Each of the shafts 2, 3 and 4, 5 is assigned at least one eccentric mass 10, 11 and 12, 13. The eccentric masses 10, 11 and 12, 13 are arranged on the shafts 2, 3 and 4, 5 and are continuously adjustable both in the direction of the arrow A and in the direction of the arrow B through a rotational angle of at least 90°.

Adjustment rollers 14, 16 and guide rollers 15, 17 are provided, with the respective axes thereof extending parallel to the shafts 2, 3 and 4, 5. The adjustment rollers 14, 16 are arranged in a central zone between the eccentric masses 10, 11 and 12, 13, orthogonally to the connecting lines 6 and and can be adjustable within limits in a straight line in the directions designated by the arrows C and D in FIGS. 1 and 2.

The eccentric masses 10, 11 and 12, 13 are provided with teeth arranged around the circumference, which are not shown in the drawings. This also applies to the adjustment rollers 14 and 16 and to the guide rollers 15 and 17. The teeth of the eccentric masses 10, 11 and 12, 13 and the corresponding adjustment rollers 14, 16 and guide rollers 15, 17, engage one of the serrated belts 18 and 19 forming the continuous pull element or endless belt. As can be seen, the serrated belt is looped around the two eccentric masses 10, 11 and the guide roller 15 while the serrated belt 19 is looped around the two eccentric masses 12 and 13 as well as the guide roller 17 thereby resulting in the forcible synchronization of the eccentric masses 10, 11 and 12, 13.

Of course, more than four shafts with eccentric masses can be used, for example, six or eight of such shafts may be provided with each arranged in groups, in order to achieve a targeted striking and pulling action.

On start-up, the eccentric masses are in the neutral position shown in FIG. 1, that is, they generate no striking action. As a result, the four-shaft vibration pile driver can be run up to the required speed without harmful vibration or resonance being developed.

Figure 2:
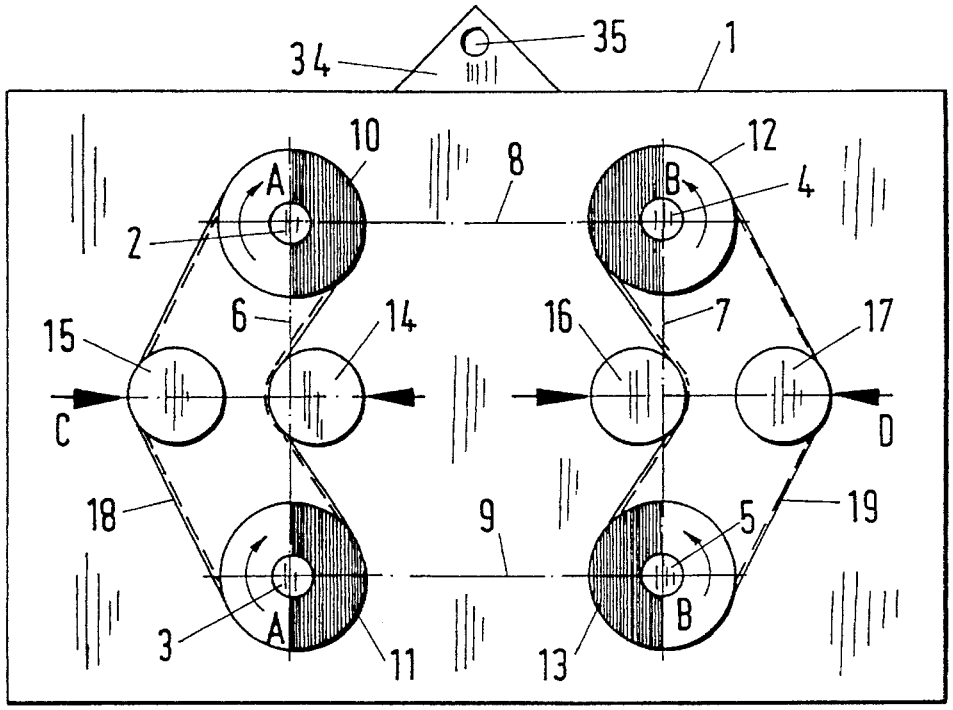
FIG. 2 is a schematic view of a vibration pile driver of FIG. 1, with eccentric masses activated.

Next, the drive of the adjustment rollers 14, 16 is activated moving them into the position shown in FIG. 2 or into any other intermediate position required, and the adjustment rollers 14, 16 are arrested or locked in the intermediate or final position required. The adjustment travel of each of the guide rollers 14, 16 is equal in length. Furthermore, the adjustment of the guide rollers 14, 16 is synchronized and in the same direction.

This results in the forcibly synchronized eccentric masses, 10, 11 and 12, 13 being adjusted (rotated) in the circumferential direction via the respective serrated belts 18 and 19. FIG. 2 illustrates the maximum extent of rotation, at which the four-shaft vibration pile driver generates its maximum striking force. In this position, the eccentric masses 10, 11 and 12, 13 are rotated synchronously and in the same direction through 90° relative to FIG. 1. This can take place during the operation of the four-shaft vibration pile driver so that the centrifugal force can be run up or down to the power required in each case during operation in accordance with the existing operating conditions, for example, the ground conditions.

Figure 3:
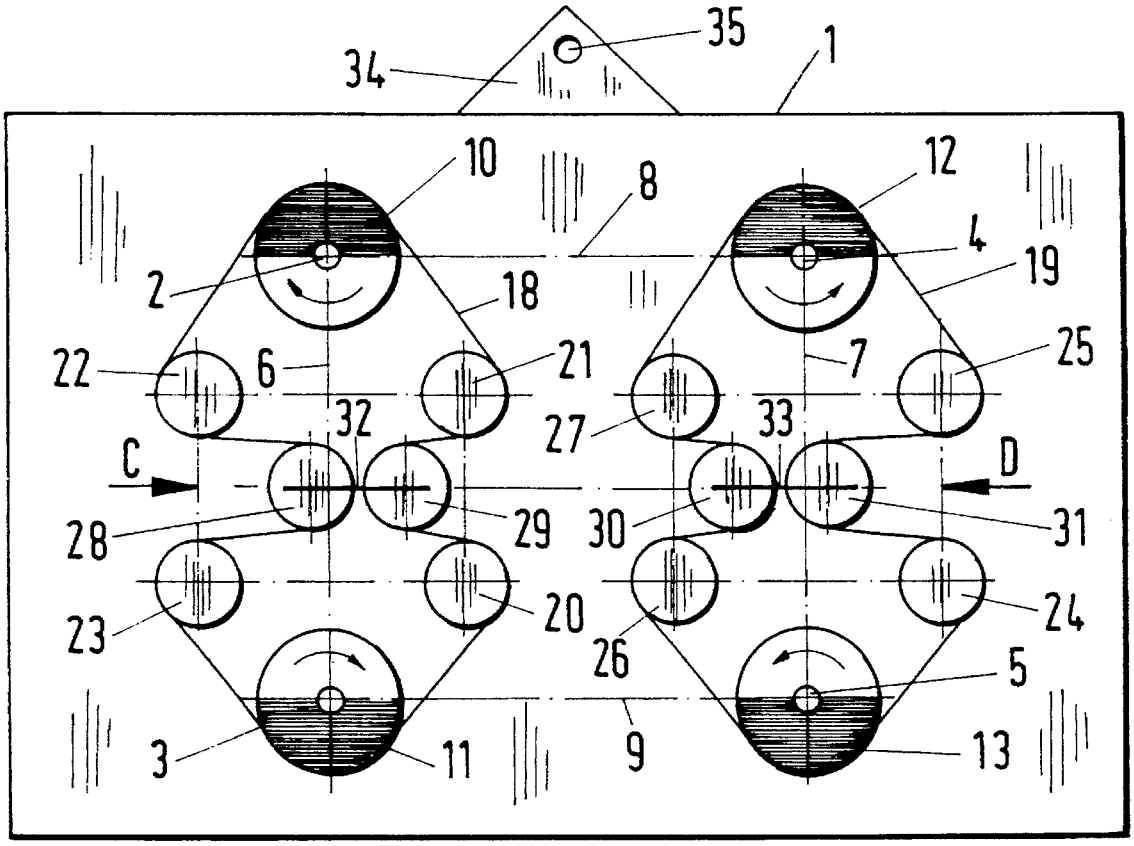
FIG. 3 is a schematic view of a further embodiment of a four shaft vibration pile driver of the present invention with eccentric masses in a neutral position.
Figure 4:
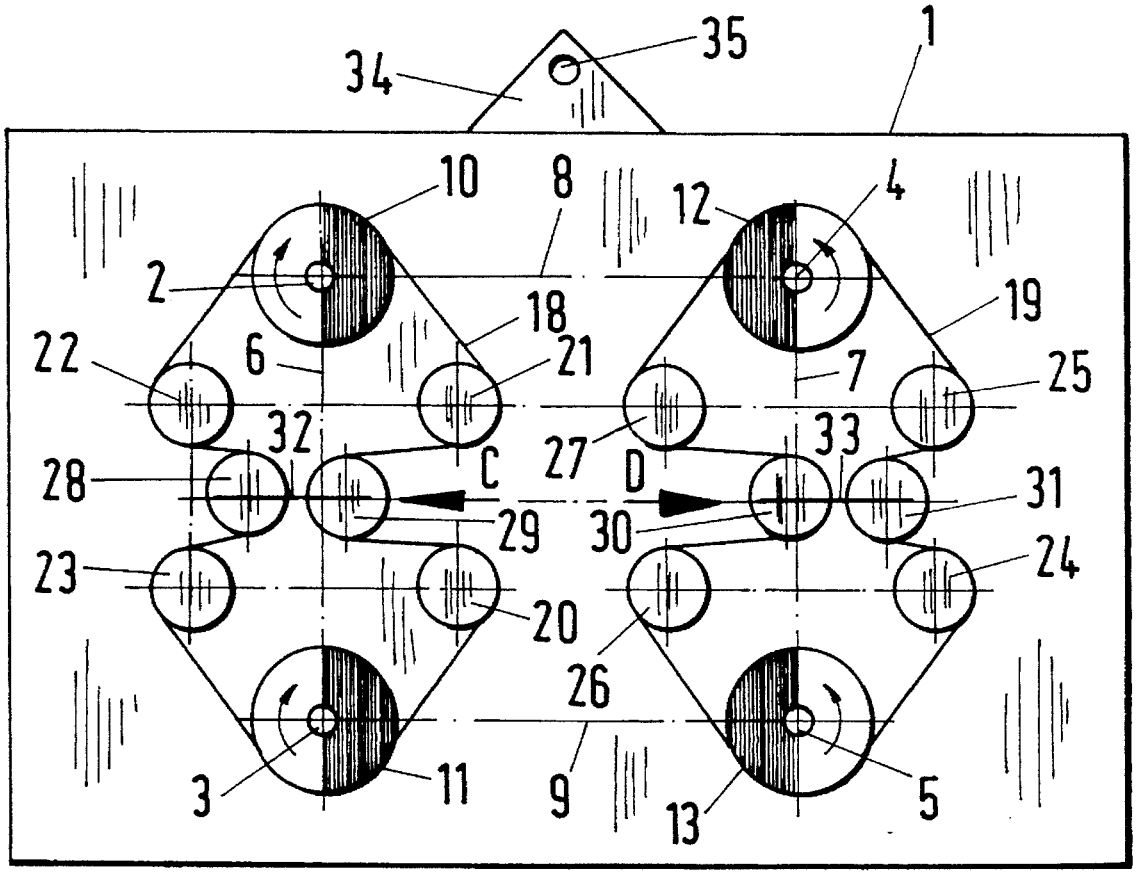
FIG. 4 is a schematic view of the vibration pile driver of FIG. 3 with the eccentric masses activated.

In the embodiment shown in FIGS. 3 and 4, the same reference numerals have been used for parts with identical functions as used for the embodiment in FIGS. 1 and 2. The eccentrics 10, 11 and 12 and 13 are in their neutral position in FIG. 3 and in FIG. 4 shown in their activated position rotated through 90°. Reference numerals 20–27 are used to designate fixed guide rollers.

Each of the pair of rollers 28, 29 and 30, 31 is respectively arranged on a straight line guide 32 and 33 and can be respectively adjusted simultaneously and synchronously in the directions of the arrows C and D. Synchronous adjustment of the two pairs of rollers 28, 29 and 30, 31 is effected mechanically or hydraulically by gears or pistons.

A suspension bearing 34 is individually and immovably connected in the rigid vibrator cell 1. The bearing 34 has a central hole 35 for connection with a cable or chain on which the vibration pile driver is suspended from a crane or similar device. As a rule, a suitable shock absorber is interposed in order to prevent harmful vibrations reaching the boom of the crane or a similar device.

Figure 5:
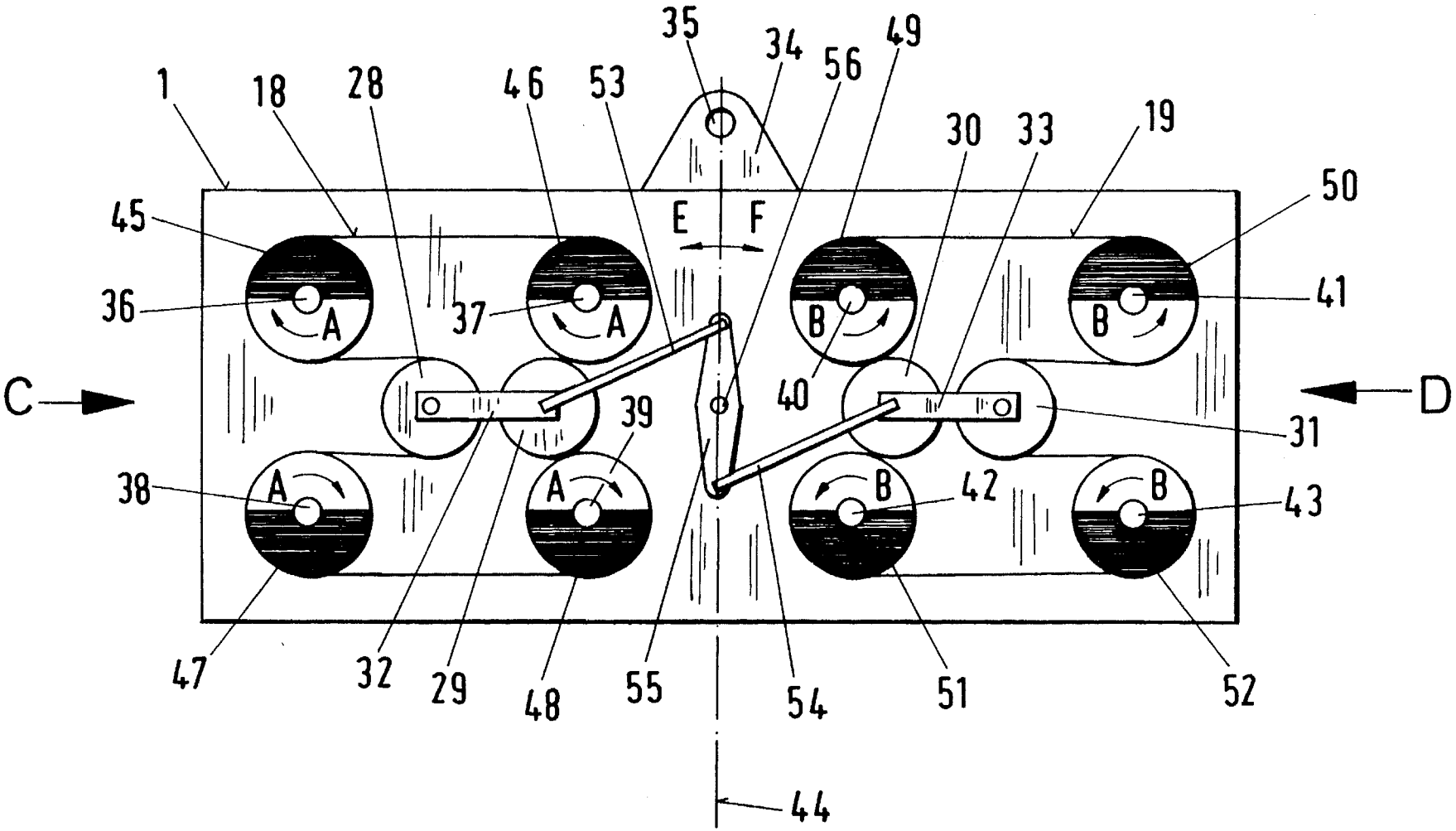
FIG. 5 is a schematic view of an eight-shaft vibration pile driver constructed in accordance with the present invention with the eccentric masses in a neutral position.
Figure 6:
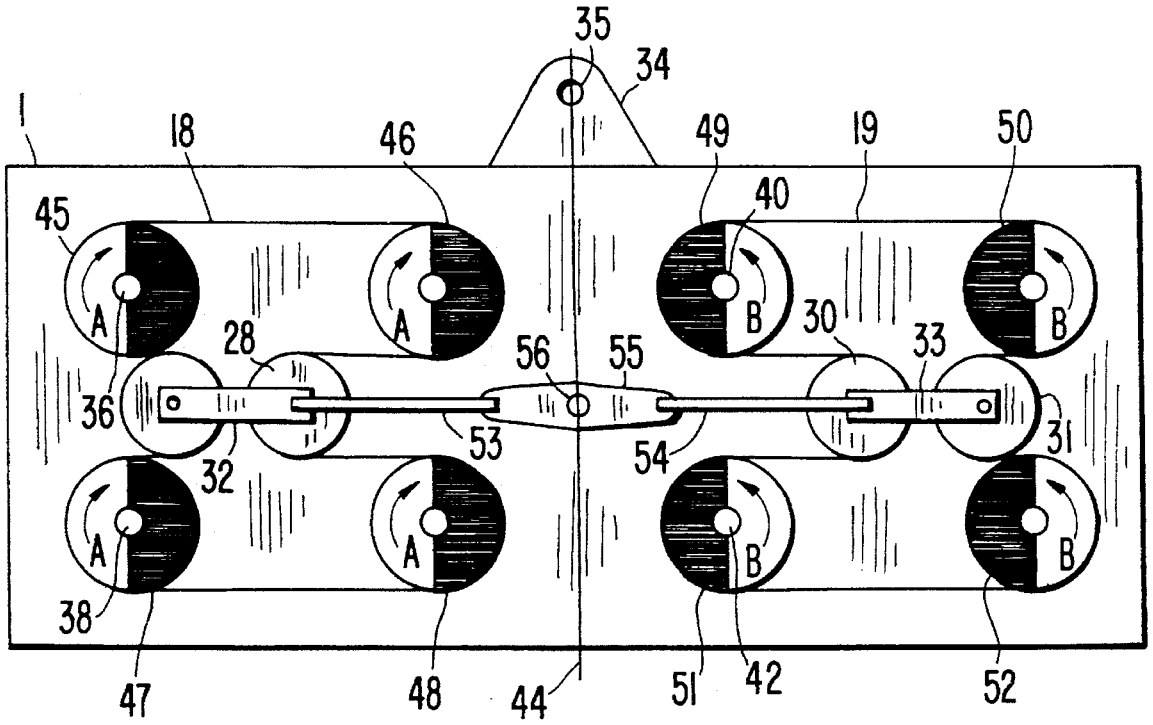
FIG. 6 is a schematic view of the vibration pile driver of FIG. 5 with the eccentric masses activated.

In the embodiment of FIGS. 5 and 6, the same reference numerals have been used for parts with identical functions as used for the embodiments described hereinabove.

Four eccentric agitators are arranged in pairs and in the same horizontal and vertical planes on each side of a straight axis of symmetry 44 extending through the center of the hole 35. These agitators are equal in size and in performance and are driven at the same speed. The directions of rotation are indicated by the arrows A and B. For example, in the case of the hydraulic drive, hydro-static motors can also be used in this embodiment on each of the shafts 36, 37, 38 and 39 and on 40, 41, 42 and 43. As shown in FIGS. 5 and 6, four such shafts are arranged in pairs above and next to each other on each side of the axis of symmetry 44, and are located in the same vertical and horizontal planes, and are also supported in the rigid vibrator cell 1. Pairs of shafts 36, 37 and 38, 39 and shafts 40, 41 and 42, 43 are arranged equidistant from the axis of symmetry 44.

Eccentric masses 44, 45, 46, and 47, 48 as well as 49, 50 and 51, 52 are equal in size and assigned to the shafts 36 to 43. The straight connecting line, which runs through the center points of the shafts 36, 37 and 40, 41, on the one hand, and 38, 39 and 42, 43, on the other, extends, in each case, orthogonally to the axis of symmetry 44.

The guide rollers 28 and 29 as well as 30 and 31 are arranged on guides 32 and 33, respectively, and can be adjusted in a straight line within limits in the directions of the arrows C and D. For this purpose, the guide rollers 28, 29 and 30, 31 are each coupled to an adjustment rod 53, 54, respectively, by a joint or swivel mounting. At their other end, the adjustment rods 53 and 54 are connected to an adjustment device 55, again by a joint or swivel mounting, which is assigned to the adjustment spindle 56 which can be adjusted through approximately 90° by a motor drive (not shown) in the direction of the arrows E and F. FIG. 5 shows the eccentric masses 45 to 52 in a neutral position, while FIG. 6 shows the adjustment device 55 swiveled through 90° in the direction of the arrow E by the adjustment spindle 56. This results in the uniform (synchronous) adjustment of the eccentric masses 45–52 in the same direction on each side of the axis of symmetry 44, via the flexible pull elements 18 and 19 (belts, serrated belts, chains or the like) for this purpose, the eccentric masses 45–52 are provided with suitable gear teeth cut on the periphery in the event serrated belts are being used for the flexible pull elements 18 and 19. An adjustment in the direction of the arrow F by approximately 90° returns the eccentric masses 45–52 back to the neutral position (FIG. 5). All intermediate positions can, of course, also be adjusted during operation so that once the critical speed has been passed, the driving or pulling force of the vibration pile driver can be increased up to the maximum value or continuously reduced to a minimum value. Of course, the adjustment rods 53 and 55 can also be arrested or stopped in any required position through the adjustment device 55. An adjustment scale can be provided for this purpose on the vibration pile driver. The adjustment can also be effected by remote control.

In place of two pairs of eccentric agitators on each side of the axis of symmetry 44, six, eight or even a larger number of pairs of eccentric agitators can be arranged on each side of the axis of symmetry 44. These agitators can be designed so as to be continuously adjusted and set, at the same time and in the same direction, in other words, synchronously even during operation of the vibration pile driver. This will be determined by the particular operating conditions and required driving or pulling power of the vibration pile driver.

I claim:

1. A vibration pile driver for at least one of ramming and pulling ram goods, the vibration pile driver including at least four motor-driven eccentric agitators, an eccentric mass arranged on each of the respective eccentric agitators, with adjustable static moment, wherein the respective eccentric masses are arranged on a shaft of each of the respective eccentric agitators and are adjustable relative to an effective eccentric radius, an adjustment of the respective eccentric masses is effectable synchronously, two flexible elements are provided for forcibly coupling the eccentric masses in pairs, and wherein each pair of eccentric masses are continuously adjustable in opposite directions.

2. A vibration pile driver according to claim 1, wherein at least one adjustment roller is provided for enabling the adjustment of each flexible element.

3. A vibration pile driver according to claim 2, wherein the at least one adjustment roller is adjustable orthogonally to a straight line connecting center points of the respective shafts.

4. A vibration pile driver according to one of claims 1, 2 or 3, wherein the flexible elements are fashioned as serrated belts looped around the eccentric masses and around guide rollers arranged off-center between the respective shafts.

5. A vibration pile driver according to one of claims 1, 2 or 3, wherein the pairs of eccentric masses are arranged on respective sides of an axis of symmetry extending through a center of a hole of a suspension bearing of a rigid vibrator cell of the vibration pile driver, and wherein guide rollers for the respective pairs of eccentric masses are continuously adjustable from a neutral position to an activated position by adjustment rods controllable by an annularly adjustable adjustment device.

6. A vibration pile driver according to one of claims 1, 2 or 3, wherein a separate drive motor is provided for each of said shafts, and wherein all of said drive motors are connected to the same power source.

7. A vibration pile driver according to claim 6, wherein the separate drive motors are hydro-static drive motors.

8. A vibration pile driver according to claim 7, wherein the same power source includes a hydraulic pressure conduit devoid of splitters and volume regulators.

* * * * *